US006428340B2

(12) United States Patent
Okabe et al.

(10) Patent No.: US 6,428,340 B2
(45) Date of Patent: Aug. 6, 2002

(54) WIRE EQUIPMENT

(75) Inventors: Toshiaki Okabe; Masahiro Noda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/838,195

(22) Filed: Apr. 20, 2001

(30) Foreign Application Priority Data

Apr. 21, 2000 (JP) ..... 2000-120868

(51) Int. Cl.[7] ..... H01R 13/625
(52) U.S. Cl. ..... 439/347; 439/310; 439/248
(58) Field of Search ..... 439/310, 342, 439/347, 376, 34, 247, 248

(56) References Cited

U.S. PATENT DOCUMENTS 5,224,018 A * 6/1993 Kobayashi ..... 361/391
6,217,363 B1 * 4/2001 Takata ..... 439/342

FOREIGN PATENT DOCUMENTS

JP 07-045337 2/1995

* cited by examiner

*Primary Examiner*—Khiem Nguyen
(74) *Attorney, Agent, or Firm*—Finnegan, Henderson, Farabow, Garrett, & Dunner, L.L.P.

(57) ABSTRACT

First housing 12 has a first connector 22. Second housing 11 has a second connector 17. First guide mechanism 13, 14 is for guiding the first housing 12 and the second housing 11 to be moved at first displacement D1 of first component C1 and second component C2 for assembly with each other. The first component C1 allows the first and second connectors 22,17 to be mated with each other. The second component C2 allows the second connector 17 and the second housing 11 to be moved relatively at second displacement D2.

14 Claims, 3 Drawing Sheets

WIRE EQUIPMENT

BACKGROUND OF THE INVENTION

1. Field of the Invention

The present invention relates to a wire equipment and, more particularly, to a wire equipment employed for a vehicle such as in meter module, audio deck, or navigation system.

2. Description of Relevant Art

A conventional mounting technology of wire equipment for a vehicle is cited in Japanese Patent Application Laid-Open Publication No. 7-45337 (Japanese Patent No. 2956741).

An instrument panel has a guide groove formed thereto. A body has a connector. The instrument panel is assembled with a case for housing electrical equipment. This case has a mating connector mounted thereto at its wire harness end and to be mated with the body connector.

The guide groove of the instrument panel includes a horizontal groove along the direction of pushing the case during assembly, and a vertical groove extending downward from the terminal of horizontal groove at right angle. The case has a roller to be guided by the guide groove of the instrument panel. Thus, the roller runs along the horizontal groove and comes down along the vertical groove upon reaching the terminal of horizontal groove. With this, the mating connector comes down to be joined to the body connector.

Recently, the electrical equipment advances in multiple functionalization have increased numbers of wires coming from the electrical equipment. Thus, advances in multi-polarization increase numbers of mating connectors and connection terminals. Thus, when the multi-polarized mating connectors and body connectors are mated with each other, a large mating load is necessary. The above-described mounting technology, due to the weight of case, and mating of the body connector and mating connector results in a short mating load and difficulty in mounting the case with the electrical equipment.

SUMMARY OF THE INVENTION

An object of the invention is to provide wire equipment that, without depending on the electrical equipment of own weight, allows reliable and simply operated joining together of connectors and assembly with an electrical equipment.

As a first aspect of the invention, the following wire equipment is provided. The equipment includes a first housing with a first connector and a second housing with a second connector. A first guide mechanism is for guiding the first housing and the second housing to be moved at first displacement of first component and second component for assembly with each other. The first component allows the first and second connectors to be mated with each other. The second component allows the second connector and the second housing to be moved relatively at second displacement.

Preferably, the first guide mechanism includes: a first slider fixed to the first housing; and a first groove part defined by the second housing and in engagement with the first slider.

Preferably, the first groove part includes: a first portion; and a second portion in communication with the first portion. The second portion extends obliquely relative to the first portion.

Preferably, the wire equipment further includes the second guide mechanism for guiding the second connector and the second housing to be moved at the second displacement.

Preferably, the second guide mechanism includes: a second slider fixed to the second connector; and a second groove part defined by the second housing. The second groove part is engaged with the second slider.

Preferably, the second housing has a holder which holds the second connector and defines the second groove part.

Preferably, one of the first and second housing is an instrument panel.

Preferably, the wire equipment further includes a second guide mechanism for guiding the second connector and the second housing to be moved relatively at the second displacement. The second guide mechanism includes: a second slider fixed to the second connector; and the second groove part defined by the second housing and in engagement with the second slider. The second groove part is parallel with the first portion.

Preferably, the second component is equal to the second displacement.

According to the aspect, with a push operation of the first or second housing in an assembly direction, the first guide mechanism guides the first and second housing to be moved at the first displacement. The first and second connectors come close to each other. The first and second connectors are moved at the first component to be mated with each other. While mating the first and second connectors, the first and second connectors are moved at the second component, so that the second connector and second housing are moved relatively at the second displacement. Thus, for example, with pushing the first or second housing in an assembly direction, a component force, being generated while the first and second housing are guided, causes the first and second connectors to be mated with each other.

Thus, an assembly operation of the wire equipment is easy and reliable, thus improving productivity.

According to the first slider and groove, a reliable and simple-structured mounting operation is performed.

According to the second guide mechanism, while mating the first and second connectors, it guides the second connector and the second housing to be moved relatively at the second displacement.

The electrical equipment is to be mounted simply and efficiently to the instrument panel on which mounting of electrical equipment concentrates.

BRIEF DESCRIPTION OF THE ACCOMPANYING DRAWINGS

DETAILED DESCRIPTION OF THE PREFERRED EMBODIMENTS

An embodiment of the present invention will hereby be explained with reference to the drawings.

Figure 1:
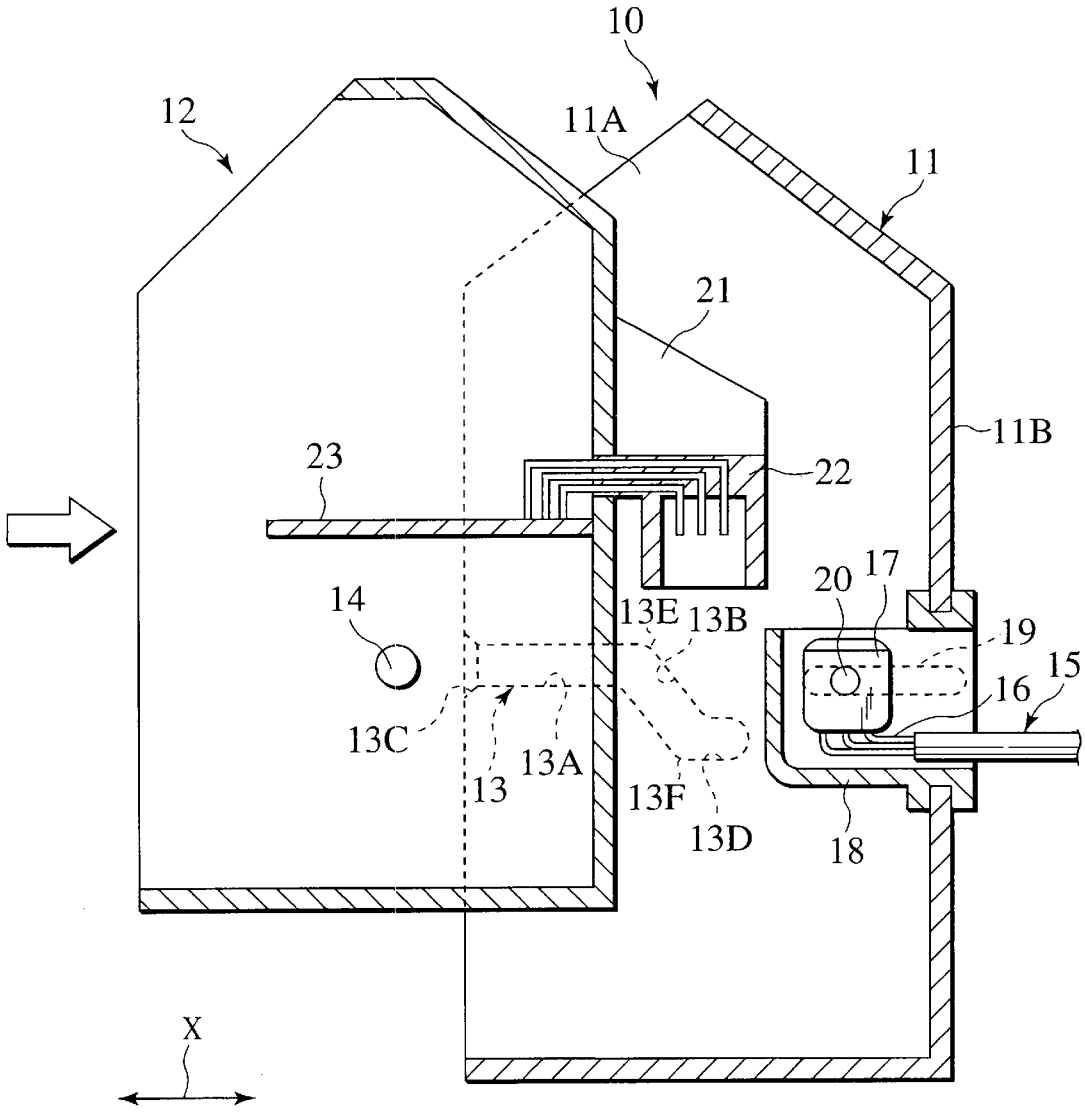
FIG. 1 is a sectional view of a wire equipment of an embodiment of the invention.
Figure 2:
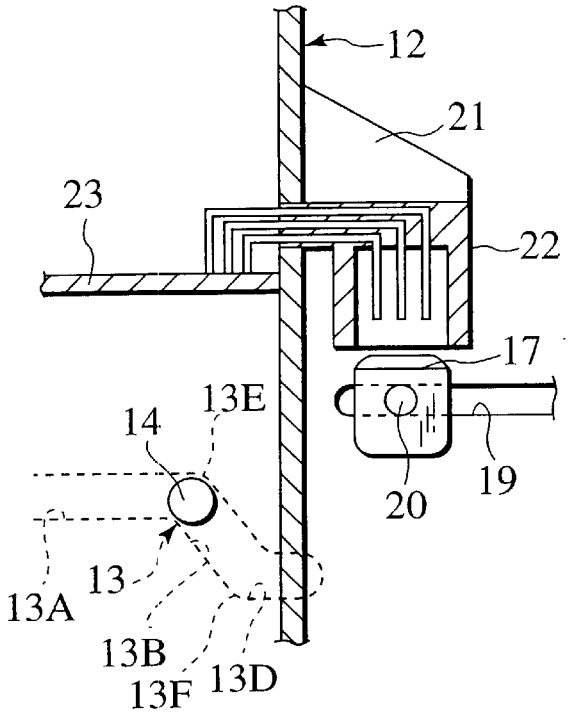
FIG. 2 is a sectional view of a main part showing positions of a guide protrusion and male and female connectors of an embodiment.

As shown on FIG. 1, the embodiment is a wire equipment 10 for a vehicle, where an instrument panel 11 in a vehicle is mounted with the vehicle electrical equipment.

The instrument panel 11, on FIG. 1, has guide grooves 13 defined by both side walls (not on FIGS.) facing electrical equipment housing space 11A. The guide grooves 13 each include a horizontal guide 13A defined along a X direction on FIG. 1 and an oblique guide 13B defined obliquely downward from the horizontal guide 13A at its end 13E in its insertion direction, and a terminal 13D extending from the oblique guide 13B at its end 13F and in parallel to the horizontal guide 13A. The horizontal guide 13A at its entrance 13C is in a taper configuration, which facilitates a guide protrusion 14 of electrical equipment 12 (as described later) to be inserted therein.

The housing space 11A of instrument panel 11 has a wall (rear wall) 11B positioned in the recess thereof, the wall 11B being provided with a multi-polarized male connector 17 movable in the X direction on FIG. 1, with connector 17 being connected with wires 16 of wire-harness 15 at its terminal at a vehicle body, the wire-harness in turn connected to, for example, a power supply or control circuit.

Specifically, the male connector 17, on FIG. 1, is housed in a connector holder 18 in vessel that is open at a respective part of its upper and side walls. The holder 18, on FIG. 1, is fixed to opening part defined by the instrument panel 11 at its wall 11B. The holder 18 has slide grooves 19 of a specified length, defined by both side walls thereof along the X direction of FIG. 1. The male connector 17 has slide protrusions 20 provided at its both side parts, the protrusions 20 being located in the slide grooves 19 of the holder 18 and movable in the X direction along the grooves 19. The male connector 17 is movable in grooves 19 and, to keep connector join faces facing normally upward, has a guide structure (not on FIGS.).

The electrical equipment 12 has guide protrusions 14 to be inserted in the grooves 13 and provided at both outer side walls thereof. The equipment 12 has a bracket 21 formed integrally on its front portion, and on a lower face of the bracket 21, a female connector 22 is fixed as a hood, with its join face downward. The female connector 22 of the equipment 12 has a circuit substrate 23 connected and fixed at its terminal end.

The connection of instrument panel 11 and equipment 12 is performed by the guide protrusions 14 being inserted in the guide grooves 13, the equipment 12 being pushed in the X direction, causing respective protrusion 14 to pass through the horizontal guide 13A and obliquely downward and forward along the oblique guide 13B. This series of movements causes male and female connectors 17 and 22 to be mated and connected with each other. When the respective protrusion 14 reaches terminal 13D that communicates with the oblique guide 13B from its end 13F, mounting operation is completed.

Next, a mounting method of a vehicle electrical equipment of the embodiment, operation and function thereof are explained, employing FIGS. 1 to 6.

Equipment 12 is attached to instrument panel 11 in the housing space 11A, by inserting guide protrusion 14 into a guide groove 13 at its entrance 13C. While pushing the equipment 12, the protrusion 14, as shown on FIG. 2, slides in the horizontal guide 13A to reach its front end 13E. At this time, the female connector 22 of equipment 12 is positioned above the male connector 17 of instrument panel 11.

Figure 3:
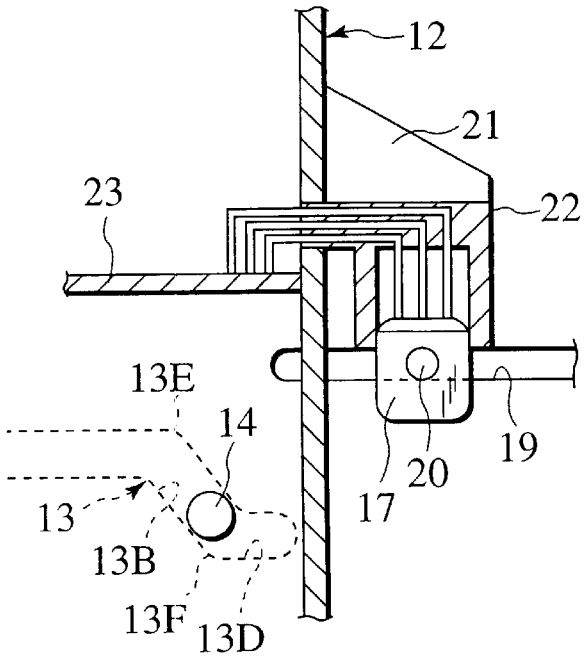
FIG. 3 is a main sectional view showing a respective position of a guide protrusion and male and female connectors of an embodiment.

When equipment 12 is pushed further forward, the protrusion 14, on FIG. 3, slides along the guide groove 13 and comes down its oblique guide 13B. At the same instant, the female connector 22 starts to be mated with the male connector 17, drawing a locus identical to that of the protrusion 14. On FIG. 5, force F which represents pushing the protrusion 14 forward (via force pushing the equipment 12) makes the protrusion 14 be pushed obliquely downward with a component force of vector F1 in the same FIG. Protrusion 14 is pushed by a push force of vector F2 against the oblique guide 13B at its upper wall and receives a reaction force in the opposite direction.

Figure 4:
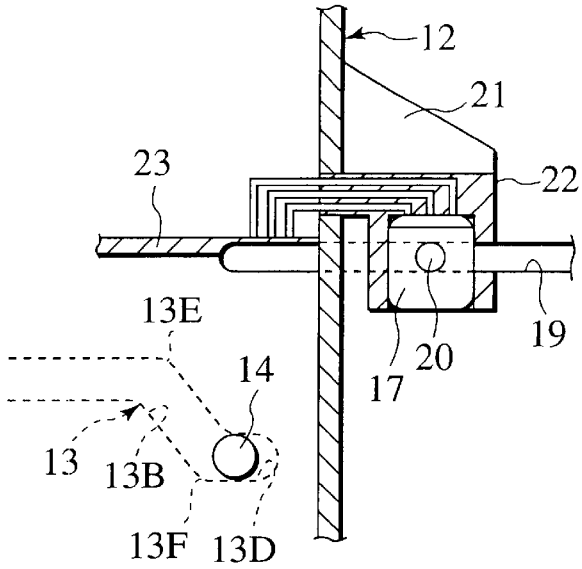
FIG. 4 is a main sectional view showing a guide protrusion and male and female connectors of an embodiment.
Figure 5:
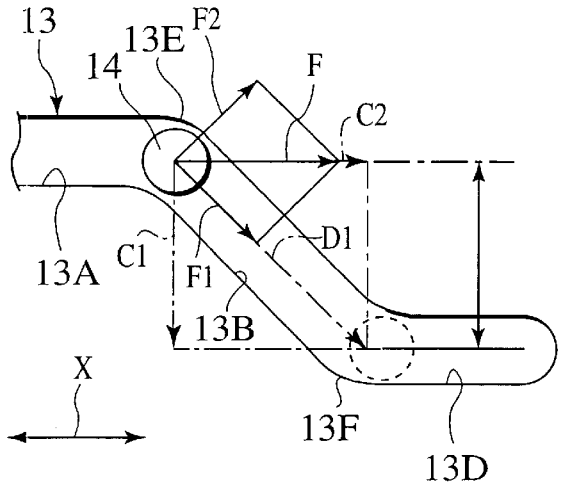
FIG. 5 is an explanation view showing function to apply to a guide protrusion of an embodiment.
Figure 6:
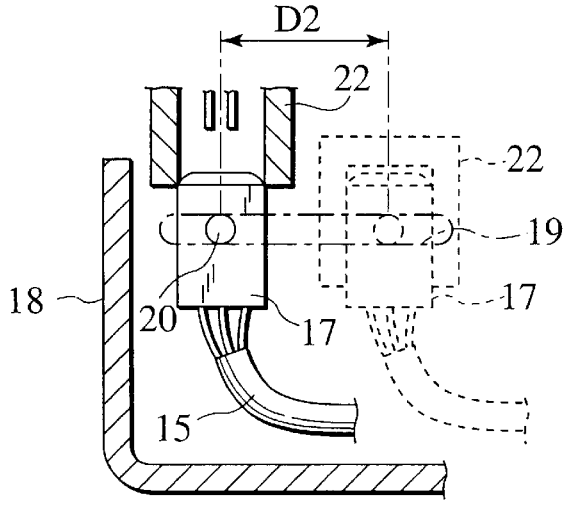
FIG. 6 is an explanation view showing a mounting operation of male and female connectors of an embodiment.

In addition, when the equipment 12 is pushed, the protrusion 14, as shown on FIG. 4, reaches terminal 13D that communicates with end 13F of oblique guide 13B of guide groove 13. That is, protrusion 14 is moved at first displacement D1 by a first component C1 and a second component C2. At this time, the female connector 22 proceeds to be mated with the male connector 17 for complete integration. The female connector 22 moves obliquely downward, moving in the X direction due to the second component C2 and downward due to the first component C1. Owing to second component C2, the protrusion 20 of male connector 17, as shown on FIG. 6, slides into slide groove 19 to move forward in the X direction at second displacement D2 relative to the panel 11, to finish mating at a broken line position. Finally, equipment 12 is fixed to the instrument panel 11 by a machine screw such as a vis, and this completes the mounting operation. In the embodiment, the second displacement D2 is a sum of the second component C2 and the length of the terminal 13D, while a second displacement D2 may be equal to the second component C2.

According to the vehicle wire equipment of the above-described embodiment and the mounting method thereof, without depending on the weight of electrical equipment 12 pushing equipment 12 forward in the X direction causes the push component force to function as a mating force with the mate and female connectors 17 and 22. Thus, even if there are further advances in multi-polarization of connectors to increase a mating load, reliable mating is assured.

When removing equipment 12 from instrument panel 11, by pulling the equipment, the guide protrusion 14 comes up along the terminal 13D and oblique guide 13B and thereafter reaches the horizontal guide 13A, allowing the equipment 12 to be removed easily. At this time, the female connector 22 is automatically removed from the male connector 17, and removal is performed by a single operation.

Although the aforementioned explains the embodiment, the invention is not limited to it. Modifications and variations of the embodiments described above will occur to those skilled in the art, in light of the above teachings. For example, in the above embodiment, the guide protrusion 14 is to be slid in the guide groove 13, while a roller to run in the guide groove 13 alternatively is to be employed.

The entire contents of Japanese Patent Applications P2000-120868 (filed on Apr. 21, 2000) is incorporated herein by reference.

The scope of the invention is defined with reference to the following claims.

What is claimed is:

1. A wire equipment comprising:

a first housing having a first connector movable relative thereto;

a second housing having a second connector fixed thereto, the second housing being configured to mate with the first housing in a first direction, the second connector being configured to mate with the first connector in a second direction crossing the first direction; and a first guide mechanism configured to guide the second housing relative to the first housing to move in a third direction crossing both of the first and the second directions, wherein the second housing is mated with the first housing in the first direction, the second connector is mated with the first connector in the second direction, and the first connector moves relative to the first housing, when the second housing is guided relative to the first housing in the third direction by the first guide mechanism.

2. A wire equipment according to claim 1, wherein the first guide mechanism includes: a first slider fixed to the second housing; and a first groove extending in the third direction in the first housing and configured to engage the first slider.

3. A wire equipment according to claim 2, wherein the first guide mechanism further includes: a second groove extending in the first direction and being in communication with the first groove.

4. A wire equipment according to claim 1, further comprising:

a second guide mechanism configured to guide the first connector relative to the first housing to move in a fourth direction.

5. A wire equipment according to claim 4, wherein the second guide mechanism includes: a second slider fixed to the first connector; and a third groove extending in the fourth direction in the first housing and configured to engage the second slider.

6. A wire equipment according to claim 5, wherein the first housing has a connector holder for holding the first connector.

7. A wire equipment according to claim 1, wherein one of the first and the second housings is an instrument panel.

8. A wire equipment according to claim 4, wherein the fourth direction is parallel to the first direction.

9. A wire equipment according to claim 8, wherein the first groove has a cosine relative to the first direction identical in length to the third groove.

10. A wire equipment comprising:

a first housing comprising a first connector and a first slider; and a second housing comprising a second connector, a first groove part configured to receive the first slider, a second slider fixed to the second connector, and a second groove part configured to receive the second slider;

wherein the first connector and second connector are engaged with each other when the first slider in the first housing is guided through the first groove part of the second housing and, at the same time, are moved relative to the second housing by the second slider guiding through the second groove part of the second housing.

11. A wire equipment according to claim 10, wherein the first groove part includes a first portion and a second portion being in communication with the first portion and extending obliquely relative to the first portion.

12. A wire equipment according to claim 10, wherein the second housing has a connector holder for holding the second connector.

13. A wire equipment according to claim 10, wherein one of the first and the second housings is an instrument panel.

14. A wire equipment according to claim 10, wherein the second grove part is parallel with the first portion of the first groove part.

* * * * *